US006575313B1

(12) United States Patent
Chen

(10) Patent No.: US 6,575,313 B1
(45) Date of Patent: Jun. 10, 2003

(54) STRUCTURE FOR FIRMLY RESTING TOOLS THEREON

(75) Inventor: Kung Cheng Chen, Taichung Hsien (TW)

(73) Assignee: E-Make Co., Ltd., Taichung Hsien (TW)

( * ) Notice: Subject to any disclaimer, the term of this patent is extended or adjusted under 35 U.S.C. 154(b) by 0 days.

(21) Appl. No.: 10/083,106

(22) Filed: Feb. 27, 2002

(51) Int. Cl.[7] ..... A47F 7/00

(52) U.S. Cl. ..... 211/70.6; 211/DIG. 1; 248/309.4; 248/206.5

(58) Field of Search ..... 211/DIG. 1, 10.6, 211/49.1, 50; 248/309.4, 206.5

(56) References Cited

U.S. PATENT DOCUMENTS 2,621,807 A * 12/1952 Rendich
2,954,874 A * 10/1960 Rouse
3,204,776 A * 9/1965 Brown et al.
4,026,415 A * 5/1977 Sarley ..... 211/70.6 X
4,043,754 A * 8/1977 Sklar ..... 211/70.6 X
4,852,930 A * 8/1989 Agee ..... 211/70.6 X
5,344,012 A * 9/1994 Matthews
5,725,096 A * 3/1998 Winnard ..... 211/DIG. 1 X
5,760,668 A * 6/1998 Testa et al. ..... 211/DIG. 1 X
5,853,092 A * 12/1998 Goodman et al. ..... 211/70.6
6,145,676 A * 11/2000 Gross ..... 211/70.6 X

* cited by examiner

*Primary Examiner*—Robert W. Gibson, Jr.
(74) *Attorney, Agent, or Firm*—Troxel Law Office PLLC

(57) ABSTRACT

Structure for firmly resting tools thereon, including a base board, a magnetic section and at least one insertion key. The base board is formed with multiple insertion holes arranged at predetermined intervals. The magnetic section is laid on the base board. The insertion key can be inserted into the insertion hole. Various tools with different configurations can be rested on the base board and the insertion keys can be inserted into the insertion holes around the tools to elastically locate the tools. In addition, the magnetic section is able to attract iron-made tools to more firmly rest the tools on the base board.

3 Claims, 4 Drawing Sheets

STRUCTURE FOR FIRMLY RESTING TOOLS THEREON

BACKGROUND OF THE INVENTION

The present invention is related to a structure for collectively and firmly resting tools thereon.

A conventional tool kit is a substantially rectangular cabinet body with six faces. Several layers of drawers are horizontally disposed in the cabinet. Each drawer simply has a room partitioned by slats into several compartments for placing various tools therein.

After the tools are placed into the drawers, the various tools are often interlaced with each other after many times of drawing/pushing of the drawers or moving of the entire tool cabinet. Therefore, a user needs to seek and find out the necessary tool from the randomly placed tools. Moreover, after found, the user must laboriously pull the tool apart from the other tools. Also, the randomly interlaced tools lead to a poor appearance.

There is another type of measure for collectively placing various tools thereon. Such measure is a hanging board which can be mounted on a wall. The hanging board is formed with multiple perforations arranged at intervals. A hanging hook having hook sections at two ends is disposed in each perforation. One end of the hanging hook is inserted in the perforation, while a tool can be hung on the other end of the hanging hook. However, the tools are suspended from the hanging hooks. In case of unexpected shock or earthquake, the tools may drop down.

SUMMARY OF THE INVENTION

It is therefore a primary object of the present invention to provide a structure for conveniently and firmly collectively resting various tools or parts thereon.

It is a further object of the present invention to provide the above structure on which the spaces for resting various tools can be elastically varied in accordance with the configurations of the tools.

It is still a further object of the present invention to provide the above structure on which various tools can be rested in order and conveniently managed.

According to the above objects, the structure for firmly resting tools thereon of the present invention includes a base board formed with multiple insertion holes, a magnetic section laid on the base board and at least one insertion key which can be inserted into the insertion hole.

The present invention can be best understood through the following description and accompanying drawings wherein:

DETAILED DESCRIPTION OF THE PREFERRED EMBODIMENTS

Figure 1:
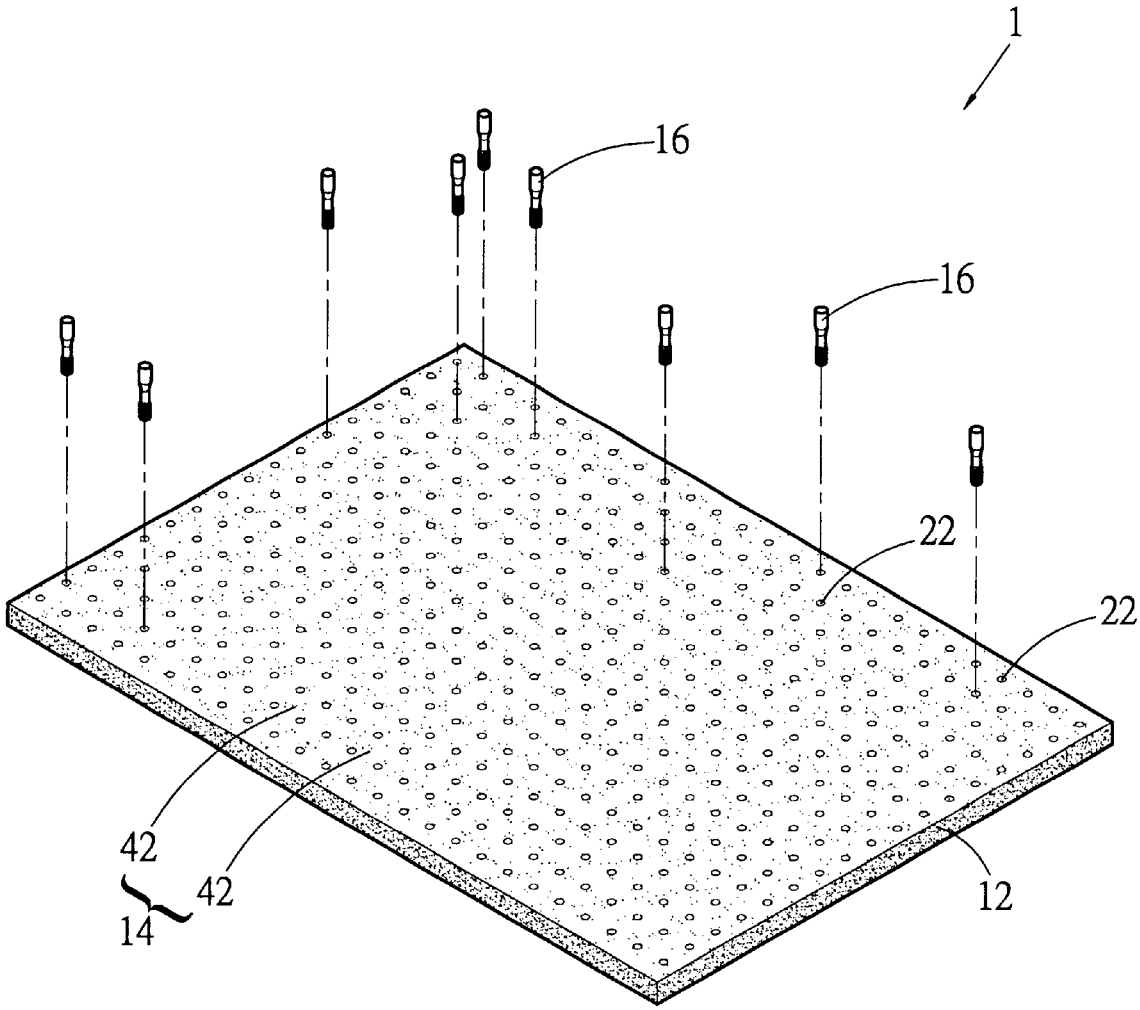
FIG. 1 is a perspective exploded view of a first embodiment of the present invention.

Please refer to FIG. 1. According to the present invention, the structure 1 for firmly resting tools thereon includes a base board 12, a magnetic section 14 and at least one insertion key 16.

The base board 12 has a predetermined shape and thickness. The base board 12 is formed with multiple insertion holes 22 with predetermined depth. The insertion holes 22 are arranged at predetermined intervals.

The magnetic section 14 is composed of multiple magnetic members 42 evenly distributed over the base board 12.

The insertion key 16 is a pin member with a predetermined length. The outer circumference of a predetermined length of one end section of the insertion key 16 has a profile corresponding to that of the inner circumference of the insertion hole 22, whereby the end section can be inserted into the insertion hole 22.

The present invention can be placed in a drawer of a tool kit or hung on a wall. Various tools with different configurations can be rested on the base board 12 and the insertion keys 16 can be inserted into the insertion holes 22 around the tools to elastically locate the tools. In addition, the magnetic section 14 is able to attract iron-made tools to more firmly rest the tools on the base board 12.

According to the above arrangement, the present invention has the following advantages:

1. By means of the insertion holes 22 and the insertion keys 16, the spaces for resting various tools can be varied in accordance with the configurations of the tools. Therefore, the various tools can be conveniently collectively stored and managed.
2. The magnetic section 14 serves to attract iron-made tools so as to more firmly rest the tools on the base board.

Figure 2:
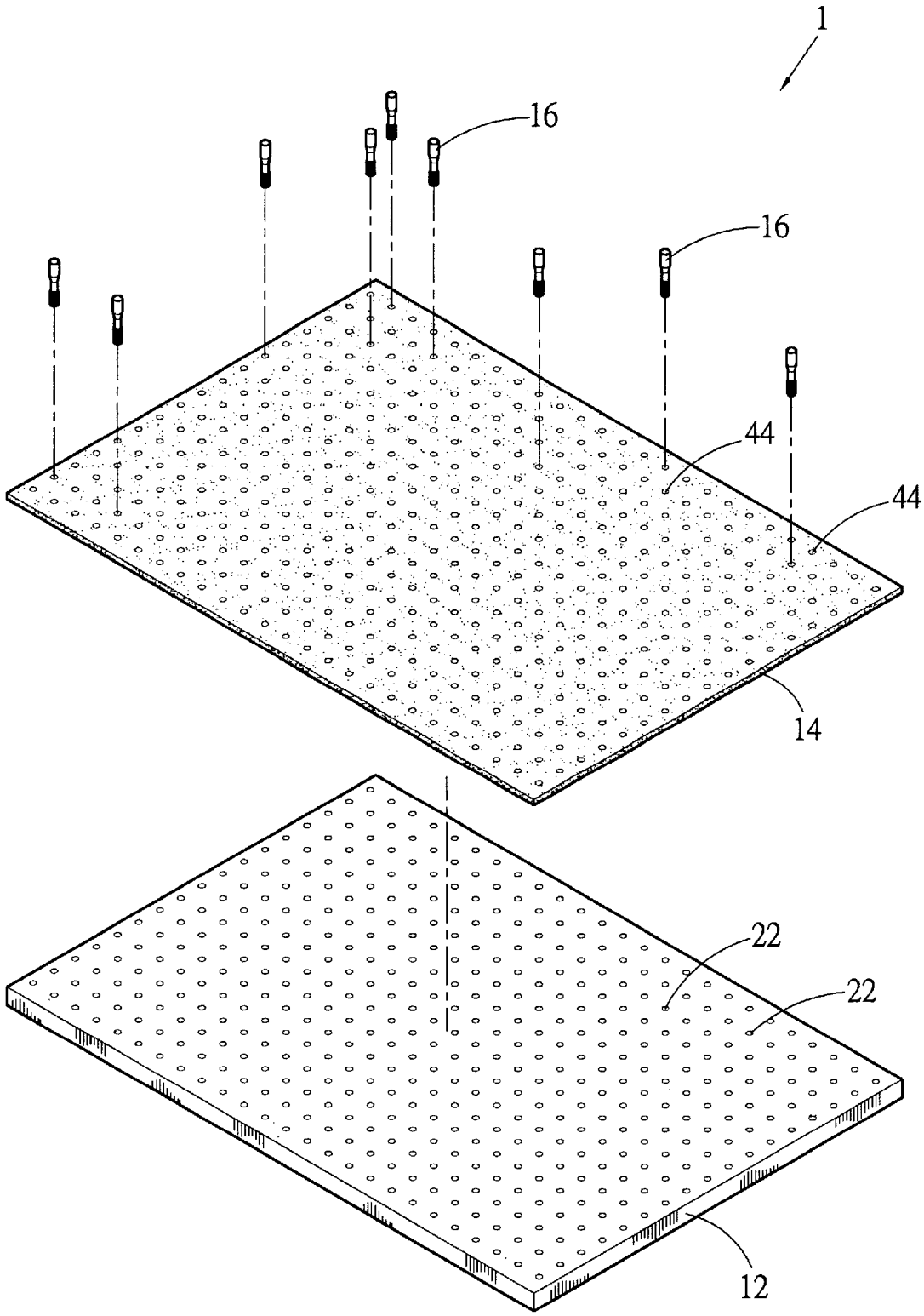
FIG. 2 is a perspective exploded view of a second embodiment of the present invention.
Figure 3:
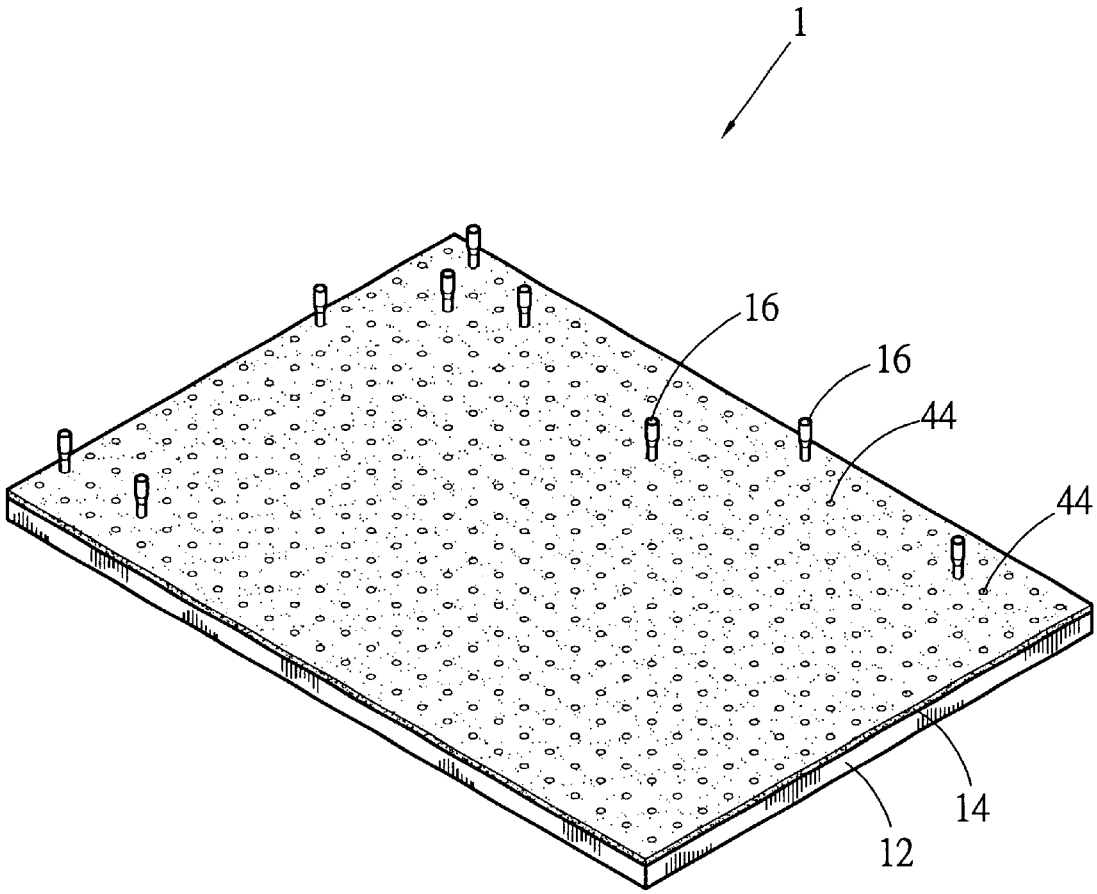
FIG. 3 is a perspective assembled view of the second embodiment of the present invention.
Figure 4:
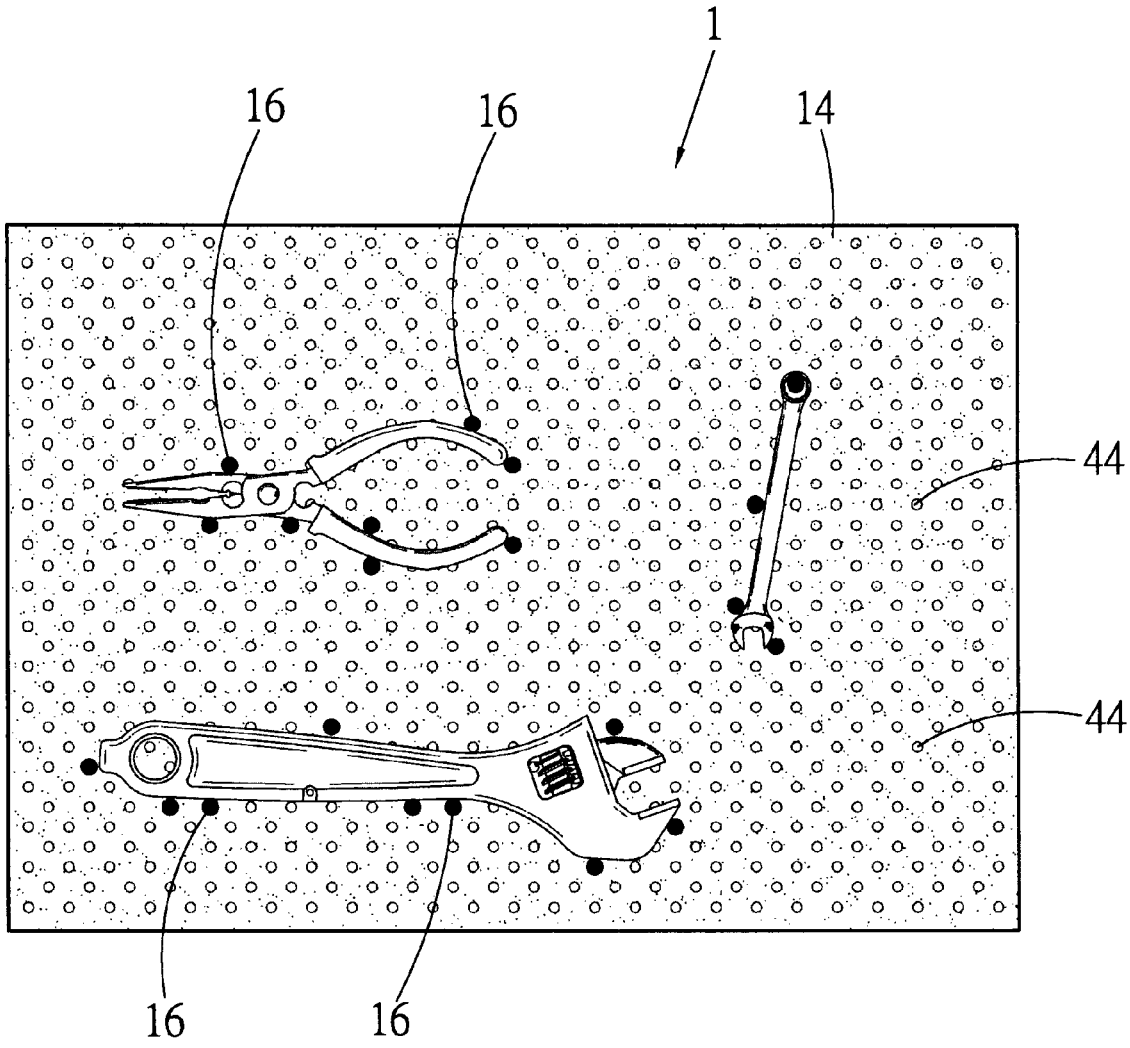
FIG. 4 is a front view of the second embodiment of the present invention.

Referring to FIGS. 2 to 4, the magnetic section 14 can be alternatively a sheet with a shape corresponding to that of the base board 12. The magnetic section 14 is formed with multiple perforations 44 corresponding to the insertion holes 22. The magnetic section 14 is laid on outer face of the base board 12 with the perforations 44 respectively aligned with the insertion holes 22.

The magnetic section 14 can be a rubber magnet or a plastic magnet.

The above embodiments are only used to illustrate the present invention, not intended to limit the scope thereof. Many modifications of the above embodiments can be made without departing from the spirit of the present invention.

What is claimed is:

1. A structure for firmly resting tools thereon, comprising:

a base board having a predetermined shape and thickness, the base board being formed with multiple insertion holes with predetermined depth, the insertion holes being arranged at predetermined intervals;

a magnetic section laid on a predetermined portion of the base board wherein the magnetic section is a sheet with a shape corresponding to that of the base board, the magnetic section being formed with multiple perforations corresponding to the insertion holes, the magnetic section being laid on outer face of the base board with the perforations respectively aligned with the insertion holes; and at least one insertion key which is a pin member with a predetermined length, an outer circumference of a predetermined length of one end section of the insertion key having a profile corresponding to that of inner circumference of the insertion hole, whereby the end section can be inserted into the insertion hole.

2. The structure for firmly resting tools thereon as claimed in claim 1, wherein the magnetic section is a rubber magnet.

3. The structure for firmly resting tools thereon as claimed in claim 1, wherein the magnetic section is a plastic magnet.

* * * * *